US008602264B2

(12) United States Patent
Lee

(10) Patent No.: US 8,602,264 B2
(45) Date of Patent: Dec. 10, 2013

(54) FOAM PRODUCTION PUMP NOT CAUSING CONTAMINATION OF CONTENTS

(75) Inventor: Chung Kee Lee, Seoul (KR)

(73) Assignee: Chong Woo Co., Ltd., Inchon (KR)

( * ) Notice: Subject to any disclaimer, the term of this patent is extended or adjusted under 35 U.S.C. 154(b) by 295 days.

(21) Appl. No.: 12/679,287

(22) PCT Filed: Oct. 27, 2008

(86) PCT No.: PCT/KR2008/006327

§ 371 (c)(1),
(2), (4) Date: Aug. 31, 2010

(87) PCT Pub. No.: WO2009/057919

PCT Pub. Date: May 7, 2009

(65) Prior Publication Data

US 2010/0314417 A1 Dec. 16, 2010

(30) Foreign Application Priority Data

Nov. 1, 2007 (KR) ..... 10-2007-0110756

(51) Int. Cl.
*B67D 7/70* (2010.01)
*B67D 7/78* (2010.01)
*B67D 7/76* (2010.01)

(52) U.S. Cl.
USPC ..... 222/190; 222/137; 222/145.1; 222/145.5

(58) Field of Classification Search
USPC ..... 222/135, 137, 145.1, 145.5, 190, 321.7, 222/321.9
See application file for complete search history.

(56) References Cited

U.S. PATENT DOCUMENTS

| | | | | | |
|---|---|---|---|---|---|
| 5,048,750 | A * | 9/1991 | Tobler | 222/190 |
| 5,255,851 | A * | 10/1993 | Tobler | 239/343 |
| 5,271,530 | A * | 12/1993 | Uehira et al. | 222/190 |
| 5,443,569 | A * | 8/1995 | Uehira et al. | 222/190 |
| 5,570,819 | A * | 11/1996 | Uehira et al. | 222/190 |
| 5,813,576 | A * | 9/1998 | Iizuka et al. | 222/190 |
| 5,881,925 | A * | 3/1999 | Ando | 222/190 |
| 6,053,364 | A * | 4/2000 | van der Heijden | 222/145.6 |
| 6,398,079 | B1 * | 6/2002 | Garcia et al. | 222/190 |
| 6,536,629 | B2 * | 3/2003 | van der Heijden | 222/190 |

(Continued)

FOREIGN PATENT DOCUMENTS

| | | |
|---|---|---|
| KR | 10-0632932 | 9/2006 |
| KR | 10-0657983 | 12/2006 |

(Continued)

*Primary Examiner* — Paul R Durand
*Assistant Examiner* — Vishal Pancholi
(74) *Attorney, Agent, or Firm* — Ladas & Parry, LLP

(57) ABSTRACT

A foam production pump includes a button (110) having an outlet port (112), a housing (120), a closure (130) for mounting the housing to a container, a stem (170) performing an up-and-down motion, a shaft (150) mounted in the lower part of the button, a foam net (158) for producing foam, a housing cap (140) for isolating an air space and a solution space of the housing from each other, an air piston (126), a solution piston (180) mounted at the outside of the stem, an air valve (128) for opening and closing a piston air hole, a first compression spring (160) disposed between the shaft and the solution piston, a second compression spring (165) disposed between the shaft and a support groove of the housing cap, and an opening and closing member (200) for opening and closing a lower end inlet port of the housing when pumping.

4 Claims, 9 Drawing Sheets

(56) References Cited

U.S. PATENT DOCUMENTS

| | | | | |
|---|---|---|---|---|
| 6,612,468 | B2 * | 9/2003 | Pritchett et al. | 222/190 |
| 6,913,169 | B2 * | 7/2005 | Lee | 222/321.2 |
| 7,055,721 | B2 * | 6/2006 | Lee | 222/321.9 |
| 7,147,133 | B2 * | 12/2006 | Brouwer et al. | 222/145.5 |
| 2002/0056730 | A1 * | 5/2002 | van de Heijden | 222/190 |
| 2003/0080157 | A1 * | 5/2003 | Iizuka et al. | 222/190 |
| 2003/0155377 | A1 * | 8/2003 | Lee | 222/321.7 |
| 2004/0084481 | A1 * | 5/2004 | Foster et al. | 222/190 |
| 2005/0023299 | A1 * | 2/2005 | Lee | 222/321.9 |
| 2005/0045658 | A1 * | 3/2005 | Lee | 222/321.7 |
| 2005/0115988 | A1 * | 6/2005 | Law et al. | 222/145.5 |
| 2006/0157512 | A1 * | 7/2006 | van der Heijden | 222/190 |
| 2007/0119864 | A1 * | 5/2007 | Tsai | 222/137 |
| 2008/0035678 | A1 * | 2/2008 | Lee | 222/320 |
| 2008/0251540 | A1 * | 10/2008 | Choi et al. | 222/190 |

FOREIGN PATENT DOCUMENTS

| | | | | |
|---|---|---|---|---|
| KR | 20-0436957 | | 10/2007 | |
| WO | WO 2005105597 | A1 * | 11/2005 | |
| WO | WO 2006112701 | A1 * | 10/2006 | B05B 11/00 |

* cited by examiner

Cleansing

Cleansing

Cleansing

FOAM PRODUCTION PUMP NOT CAUSING CONTAMINATION OF CONTENTS

CROSS-REFERENCE TO RELATED APPLICATIONS

This application is the U.S. National Stage of International Patent Application No. PCT/KR2008/006327, filed on Oct. 27, 2008, which claims priority to Korean Patent Application No. 10-2007-0110756 filed on Jan. 11, 2007, the disclosure of which are incorporated herein by reference.

TECHNICAL FIELD

The present invention relates to a foam production pump for discharging liquefied contents in the form of foam, including a button having an outlet port defined therein, a housing forming an external appearance of the pump, a closure for mounting the housing to a predetermined container, a stem mounted in the lower part of a shaft for performing an up-and-down motion, the shaft configured in a hollow channel structure, through which the contents pass, the shaft being mounted in the lower part of the button, a foam net for mixing the contents with air to produce foam, a housing cap for isolating an air space and a solution space of the housing from each other, an air piston configured in a multiple-stage structure, a solution piston mounted at the outside of the stem, an air valve for opening and closing a piston air hole, a first compression spring disposed between the lower end of the shaft and the solution piston, a second compression spring disposed between a side protrusion part of the shaft and a support groove of the housing cap, and an opening and closing member for opening and closing a lower end inlet port of the housing when pumping.

BACKGROUND ART

Generally, a foam production pump is widely used for shaving cream, hair mousse, facial cleansing cream, liquid soap, body shampoo, industrial multi-purpose cleanser, facial cleanser, etc. Also, the foam production pump is generally constructed in a structure to mix liquefied contents with an appropriate amount of gas and extrude the mixture thereby producing foam.

However, a conventional foam production pump has problems in that the foam production pump is filled with additional compressed gas, and contents are not discharged out of the foam production pump but only the compressed gas is discharged out of the foam production pump when the foam production pump is inclined. Also, the use of the compressed gas causes environment-related problems. In addition, the compressed gas may catch fire or explode. For this reason, the structure in which the foam production pump is filled with the compressed gas requires durability and complicated components, which raises the manufacturing costs of the foam production pump.

Therefore, research has been made on a foam production pump that is capable of appropriately mixing contents with external air introduced into the foam production pump to produce foam, and technologies related to the foam production pump have been continuously developed.

The foam production pump includes a housing forming the external appearance of the pump, the housing being configured to separately store external air and contents, a closure configured to mount the housing to a container, a mixing unit for mixing the contents with the air, a stem communicating with an outlet port of a cap, the stem being configured to move up and down along the housing, a shaft for guiding the up-and-down motion of the stem and connecting the step to the cap, a piston mounted to the stem for performing an up-and-down motion along an inner wall of the housing, a compression spring mounted at the lower inside of the housing, and a ball for opening and closing an inlet port formed at the lower end of the housing.

However, the conventional foam production pump has several problems.

First, the compression spring is located in a flow channel of the contents, with the result that the compression spring comes into contact with the contents. Consequently, the compression spring may be deteriorated, and the deteriorated compression spring causes the contamination of the contents.

Second, the ball, which serves to open and close the inlet port formed at the lower end of the housing, performs an operation for opening and closing the inlet port based on the change of the pressure in the housing and the gravity, with the result that the ball does not rapidly respond to a pumping action, and it is difficult for the ball to provide a high sealing force. Consequently, some of the contents may leak out to the container during pumping. Furthermore, the ball does not perform a rapid opening and closing operation, which decreases a pumping force.

Third, a structure to introduce and store external air and a structure to introduce air from the housing to the mixing unit that mixes the contents with the air when pumping are further required in addition to the structure to pump the contents, unlike a general hand-operated spray pump. As a result, the number of components constituting the foam production pump increases, and therefore, the structure of the foam production pump is complicated, whereby the foam production pump may frequently break down when in use.

Although various structures to solve the above-described problems have been developed, few of them provide a satisfactory result. Therefore, there is a high necessity for a technology that is capable of fundamentally solving the above-mentioned problems.

DISCLOSURE

Technical Problem

Therefore, the present invention has been made to solve the above problems, and other technical problems that have yet to be resolved.

Specifically, it is an object of the present invention to provide a foam production pump that is capable of efficiently and stably achieving the mixture of contents and external air, is easily assembled, has a low possibility of breakdown, and does not cause the contamination of the contents.

Technical Solution

In accordance with the present invention, the above and other objects can be accomplished by the provision of a foam production pump for discharging liquefied contents in the form of foam, including a button, having an outlet port defined therein, mounted at the upper end of a shaft, a housing forming an external appearance of the pump, the housing having an air space, into which external air is introduced, and a solution space, into which contents are introduced, defined therein, a closure coupled to an upper outside of the housing for mounting the housing to a predetermined container, a stem having a horizontal channel communicating with the solution space of the housing and a vertical channel communicating with the horizontal channel defined therein, the stem being mounted in the lower part of the shaft for performing an up-and-down motion, the shaft configured in a hollow channel structure, through which the contents pass, the shaft having an air hole (a shaft air hole), through which air from the air space is introduced, formed in an upper part thereof, the shaft being mounted in a lower part of the button, the shaft performing an up-and-down motion along an inside of a housing cap while a lower part of the shaft is coupled to an outside of the stem, a foam net mounted at an open hollow upper part of the shaft for mixing the contents with the air to produce foam, the housing cap for guiding the up-and-down motion of the shaft and isolating the air space and the solution space of the housing from each other, an air piston configured in a multiple-stage structure, the air piston performing an up-and-down motion along an inside of the air space of the housing while being mounted at the lower part of the button, the air piston having an air hole (a piston air hole) formed in a middle part thereof, a contact region (S) between the air piston and the shaft being opened and closed during pumping, a solution piston mounted at the outside of the stem for opening and closing the horizontal channel of the stem, the solution piston performing an up-and-down motion along an inside of the solution space of the housing, an air valve having a vertical section configured in an L type structure coupled to the multiple-stage structure of the air piston, the air valve opening and closing the piston air hole during pumping, a first compression spring disposed between a lower end of the shaft and the solution piston for providing an elastic opening and closing force of the solution piston with respect to the horizontal channel of the stem during pumping, a second compression spring disposed between a side protrusion part of the shaft and a support groove of the housing cap for providing a restoring force to the shaft and the air piston during pumping, and an opening and closing member disposed at a lower end of the solution space for opening and closing a lower end inlet port of the housing when pumping.

In the foam production pump according to the present invention, when the button is pushed to discharge the contents in the form of foam (hereinafter, referred to as a pressurization mode), the shaft, coupled to the button, moves downward, with the result that the contents in the solution space flow to the upper part of the shaft through the horizontal channel and the vertical channel of the stem, and the air stored in the air space is mixed with the liquefied contents at the lower part of the foam net after passing through the shaft air hole located at the upper part of the shaft. The mixture of the liquefied contents and the air changes into foam while passing through the foam net located at the upper part of the shaft. The foam is discharged to the outside through the outlet port of the button.

On the other hand, when the force applied to the button is removed (hereinafter, referred to as a relaxation mode), the shaft is moved upward by the restoring forces of the first compression spring and the second compression spring, and therefore, the internal pressure of the solution space decreases. As a result, contents in the container are introduced into the solution space of the housing. The internal pressure of the air space also decreases, with the result that external air is introduced into the air space through the piston air hole.

Consequently, it is possible to supply the air in the air space to the hollow upper part of the shaft through the contact region (S) between the shaft and the air piston, which is a channel communicating with the interior of the shaft, without an additional air valve. Also, the shaft and the air piston come into contact with each other with a predetermined distance, and therefore, it is possible to easily design the contact region such that only a predetermined amount of air can be supplied into the shaft.

Also, since the second compression spring is further disposed between the side protrusion part of the shaft and the support groove of the housing cap, it is possible for the second compression spring to more easily achieve the upward movement of the shaft together with the first compression spring in the relaxation mode and to elastically increase an opening and closing force of the solution piston with respect to the horizontal channel of the stem when pumping.

Furthermore, the compression springs are located at regions except the flow channels through which the contents flows. Consequently, the compression springs provide restoring forces to the solution piston, the shaft, and the air piston, without the interference with the flow of the contents, during pumping, whereby easy pumping is achieved. Also, the contamination of the contents due to the deterioration of the compression springs is fundamentally prevented.

According to circumstances, the upper end of the stem may be formed in the shape of an anchor, and a micro protrusion may be formed at the corresponding inside of the shaft, to more securely achieve the coupling between the shaft and the stem. In this structure, the stem is inserted into and coupled to the stem from the bottom of the cylindrical structure of the shaft, whereby it is possible to easily achieve the coupling between the shaft and the stem.

Generally, the contents in the hollow channel of the shaft may be introduced into the air space through the air hole, which is provided to supply air from the air space into the shaft. Preferably, therefore, the shaft air hole includes an outside opening formed outside the shaft and an inside opening formed inside the shaft, and the outside opening is located at a higher position than the inside opening to prevent the occurrence of such a phenomenon during pumping. For example, the height difference between the outside opening and the inside opening may be 10 to 20 mm.

Preferably, the air valve includes a thin membrane formed at a region where the air valve is in contact with the piston air hole for more effectively closing the piston air hole in the pressurization mode when pumping and more effectively opening the piston air hole in the relaxation mode.

That is, the air valve can open and close the piston air hole based on the pressure state of the air space. Specifically, the air piston moves downward along the inside of the air space of the housing in the pressurization mode, with the result that the internal pressure of the air space becomes higher than the external pressure of the air space. At this time, the thin membrane of the air valve comes into tight contact with the piston air hole, with the result that the discharge of the high-pressure air to the outside is prevented. On the other hand, the air piston moves upward in the relaxation mode, with the result that the internal pressure of the air space becomes lower than the external pressure of the air space. At this time, the thin membrane of the air valve is opened by air passing through the piston air hole, with the result that the pressure difference is solved.

In a preferred embodiment, the button has an annular protrusion part formed therein, the air piston has an uppermost end disposed in contact with the annular protrusion part in a sliding fashion, and the annular protrusion part of the button and the uppermost end of the air piston are configured to provide a sliding distance in which the contact region (S) between the air piston and the shaft is opened in a pressurization mode during pumping, and the contact region (S) is closed in a relaxation mode.

The sliding connection structure between the annular protrusion part of the button and the uppermost end of the air piston is preferred because the sliding connection structure prevents the upward separation of the button and easily achieves the opening or closing of the contact region (S) between the air piston and the shaft. For example, the sliding distance of the annular protrusion part of the button and the uppermost end of the air piston may be 0.3 to 0.6 mm. Of course, the sliding distance may be adjusted depending upon a desired amount of air introduced into the hollow upper part of the shaft.

The foam net is not particularly restricted so long as the foam net is constructed in a structure to easily produce foam. For example, the foam net may be configured in a net or mesh structure to effectively produce foam. For reference, the net means a member configured in a net structure, and the mesh means a net member of a netlike textile.

Preferably, the opening and closing member is configured in a hollow structure in which the upper part of the opening and closing member is open, and the opening and closing member has radial protrusions formed at the outside thereof such that the radial protrusions extend outward, whereby it is possible for the opening and closing member to rapidly respond to the up-and-down motion of the stem and to provide a high sealing force. Also, the stem has a vertical extension part formed at a lower end thereof, and the vertical extension part moves along the hollow inside of the opening and closing member in tight contact with the opening and closing member.

Materials for the respective components constituting the foam production pump according to the present invention are not particularly restricted. Synthetic resins, including polypropylene, polyethylene such as high density polyethylene (HDPE) or linear low density polyethylene (LLDPE), and polyoxymethylene (POM), may be preferably used in consideration of easiness in forming and prices.

Also, the first compression spring and the second compression spring are generally made of stainless steel. According to circumstances, however, the first compression spring and the second compression spring may be made of plastic exhibiting high elasticity.

Advantageous Effects

As apparent from the above description, the foam production pump according to the present invention has the effect of efficiently and stably achieving the mixture of contents and external air, being easily assembled, preventing the contamination of the contents due to the compression springs, and having a low possibility of breakdown.

In a preferred embodiment, the outside opening of the shaft air hole is located at a higher position than the inside opening of the shaft air hole. Consequently, the foam production pump according to the present invention has the effect of preventing the contents in the hollow channel from flowing backward to the shaft air hole during pumping.

In another preferred embodiment, the annular protrusion part of the button and the uppermost end of the air piston are in contact with each other in a sliding fashion. Consequently, the foam production pump according to the present invention has the effect of preventing air from being discharged out of the button. Also, it is possible to easily adjust an amount of air supplied to the hollow upper part of the shaft through the adjustment of the sliding distance, and therefore, it is possible to easily design the foam production pump according to desired conditions.

In yet another preferred embodiment, the opening and closing member of a specific structure is used in place of the conventional opening and closing ball.

It is possible for the opening and closing member to rapidly respond to the up-and-down motion of the stem when pumping. Consequently, the foam production pump according to the present invention has the effect of exhibiting high sealability.

DESCRIPTION OF DRAWINGS

The above and other objects, features and other advantages of the present invention will be more clearly understood from the following detailed description taken in conjunction with the accompanying drawings, in which.

BEST MODE

Now, preferred embodiments of the present invention will be described in detail with reference to the accompanying drawings. It should be noted, however, that the scope of the present invention is not limited by the illustrated embodiments.

Figure 1:
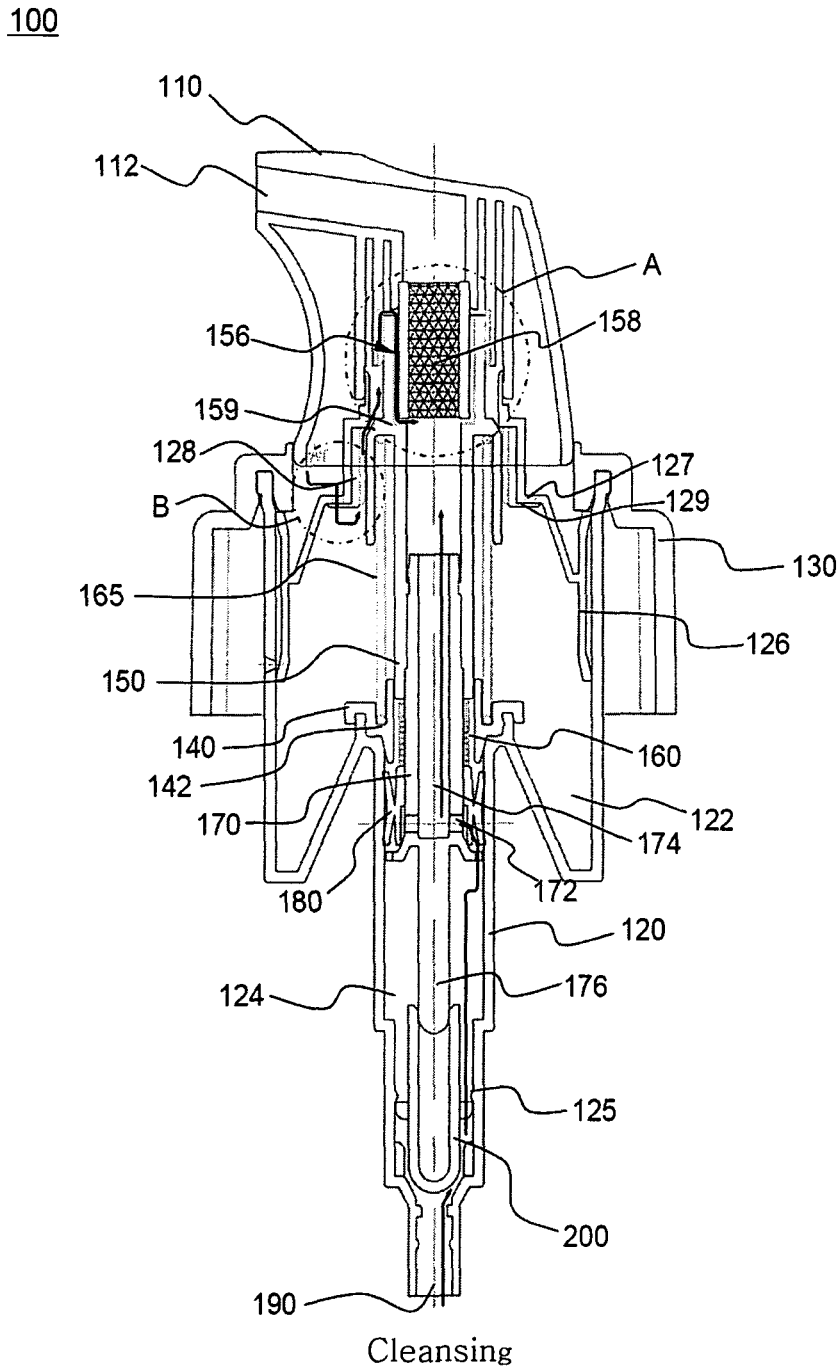
FIG. 1 is a vertical sectional view illustrating a foam production pump according to a preferred embodiment of the present invention.
Figure 2:
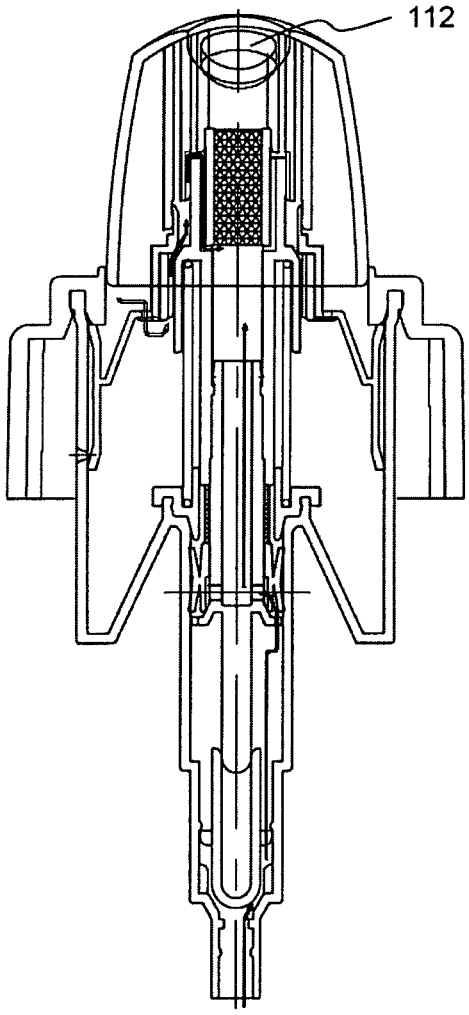
FIG. 2 is a front view illustrating the foam production pump of FIG. 1.

FIG. 1 is a vertical sectional view typically illustrating a foam production pump according to a preferred embodiment of the present invention, and FIG. 2 is a front view typically illustrating the foam production pump of FIG. 1.

Referring to these drawings, the foam production pump 100 includes a button 110, having an outlet port 112 defined therein, mounted at the upper end of a shaft 150, a housing having an air space 122 and a solution space 124 defined therein, a closure 130 for mounting the housing 120 to a container (not shown), a stem 170 mounted in the lower part of the shaft 150 for performing an up-and-down motion, a shaft 150 for performing an up-and-down motion along the inside of the housing cap 140, a foam net 158 for mixing liquefied contents with air to produce foam, the housing cap 140 for guiding the up-and-down motion of the shaft 150, an air piston 126 for performing an up-and-down motion along the inside of the air space 122, a solution piston 180 for performing an up-and-down motion along the inside of the solution space 124, an air valve 128 for opening and closing a piston air hole 127, a shaft air hole 156 formed in the upper part of the shaft 150, a first compression spring 160 disposed between the lower end of the shaft 150 and the solution piston 180, a second compression spring 165 for providing a restoring force to the shaft 150 and the air piston 126 when pumping, and an opening and closing member 200 for opening and closing a lower end inlet port 190 of the housing 120 when pumping.

The external appearance of the foam production pump 100 is mainly defined by the housing 120, which includes the multiple-stage air space 122 having a plurality of diameters and configured such that external air can be introduced into the air space 122 and the solution space 124 configured such that contents from the container (not shown) are introduced into the solution space 124, and the closure 130, by which the foam production pump 100 is mounted to the container.

The housing 120 and the closure 130 are coupled to each other by the housing cap 140, which is bent. The housing cap 140 isolates the air space 122 and the solution space 124 of the housing 120 from each other. Also, the housing cap 140 guides the up-and-down motion of the shaft 150.

The stem 170, which is mounted in the lower part of the shaft 150, includes a horizontal channel 172 for allowing the contents stored in the solution space 124 of the housing 120 to be introduced therethrough, a vertical channel 174 vertically extending to communicate with the horizontal channel 172, and a lower-end vertical extension part 176.

The horizontal channel 172 is in tight contact with the outside of the stem 170 and the inside of the housing 120, and is opened and closed by the solution piston 180, which is movable up and down. The solution space 124 is opened and closed by the opening and closing member 200, which is located right above the inlet port 190.

The first compression spring 160 is located between the lower end of the shaft 150 and the solution piston 180 for providing an elastic opening and closing force of the solution piston 180 with respect to the horizontal channel 172 of the stem 170. The second compression spring 165 is mounted between a side protrusion part 159 of the shaft 150 and a support groove 142 of the housing cap 140 for providing a restoring force to the shaft 150 and the air piston 126 when pumping. In particular, the first compression spring 160 is located outside the stem 170 through which the liquefied contents pass, and therefore, it is possible to prevent the contamination of the contents due to the contact between the contents and the first compression spring 160.

The air piston 126 is configured in a multiple-stage structure. The air piston 126 moves up and down along the inside of the air space 122 for introducing external air into the air space 122 through the piston air hole 127 and discharging the introduced air to the upper part A of the shaft 150 through the shaft air hole 156 formed in the shaft 150.

The air valve 128 includes a thin membrane 129 for opening and closing the piston air hole 127. The air valve 128 has a vertical section configured in an L type structure. The air valve 128 is mounted in the upper part of the air piston 126, which is configured in a multiple-stage structure.

Figure 3:
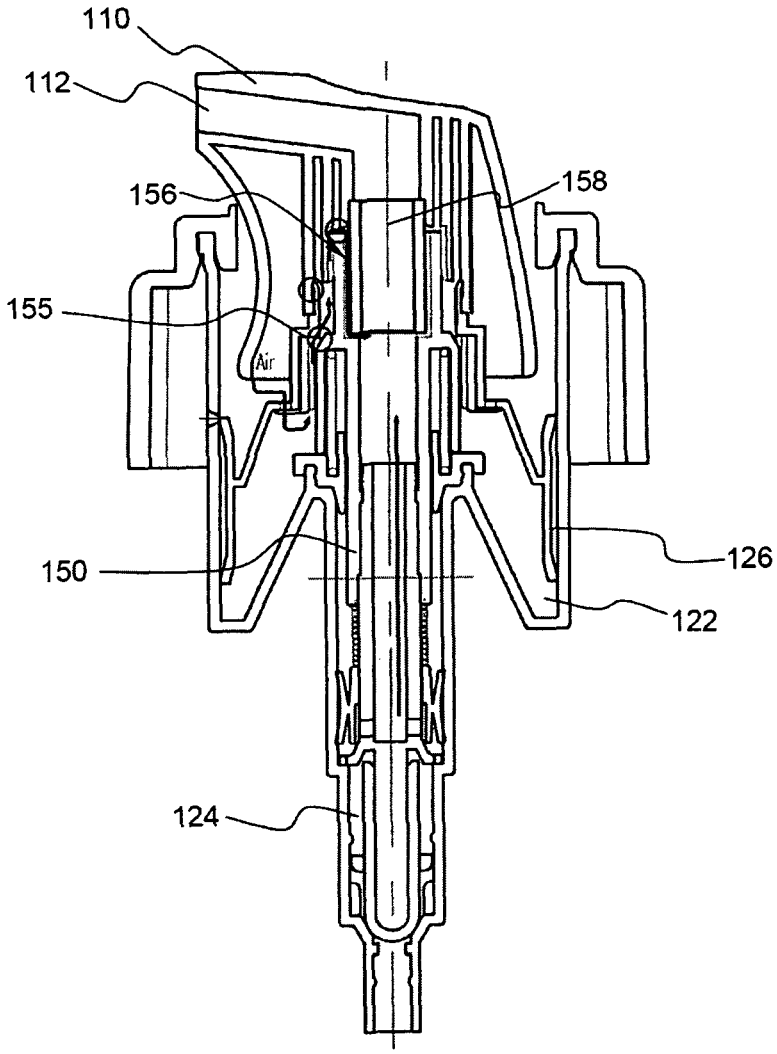
FIG. 3 is a vertical sectional view illustrating the foam production pump in a pressurization mode.

FIG. 3 is a vertical sectional view typically illustrating the foam production pump in a pressurization mode.

Referring to FIG. 3, when the button 119 is pushed, the shaft 150 coupled to the button 119 moves downward, and thus the air piston 126 moves downward to compress the air stored in the air space 122. The air stored in the air space 122, the pressure of which increases, passes through a contact region (S) 155 defined between the upper part of the air piston 126 and the upper part of the shaft 150.

The air passes through the shaft air hole 156, and some of the air is introduced into the lower part of the foam net 158 of the shaft 150. At the same time, the introduced air is mixed with liquefied contents introduced into the upper part of the shaft 150 from the solution space 124. The mixture of the liquefied contents and the air passes through the foam net 158 with the result that the mixture changes into foam. The foam is discharged to the outside through the outlet port 112 of the button 110.

Figure 4:
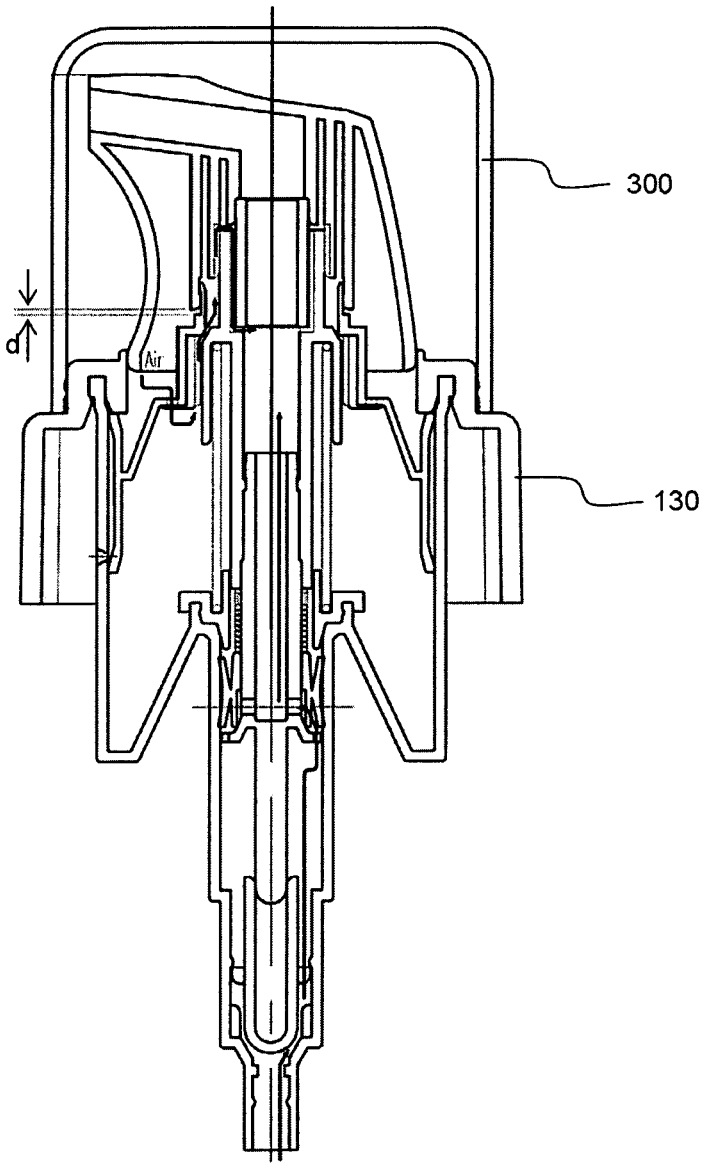
FIG. 4 is a vertical sectional view illustrating the foam production pump of FIG. 1 including an upper cap mounted thereto.

FIG. 4 is vertical sectional view typically illustrating the foam production pump of FIG. 1 including an upper cap mounted thereto.

The structure of FIG. 4 is identical to that of FIG. 1 except that the upper cap 300 is mounted outside the upper part of the closure 130 of the foam production pump 100 shown in FIG. 1, and therefore, a detailed description thereof will not be given.

Figure 5:
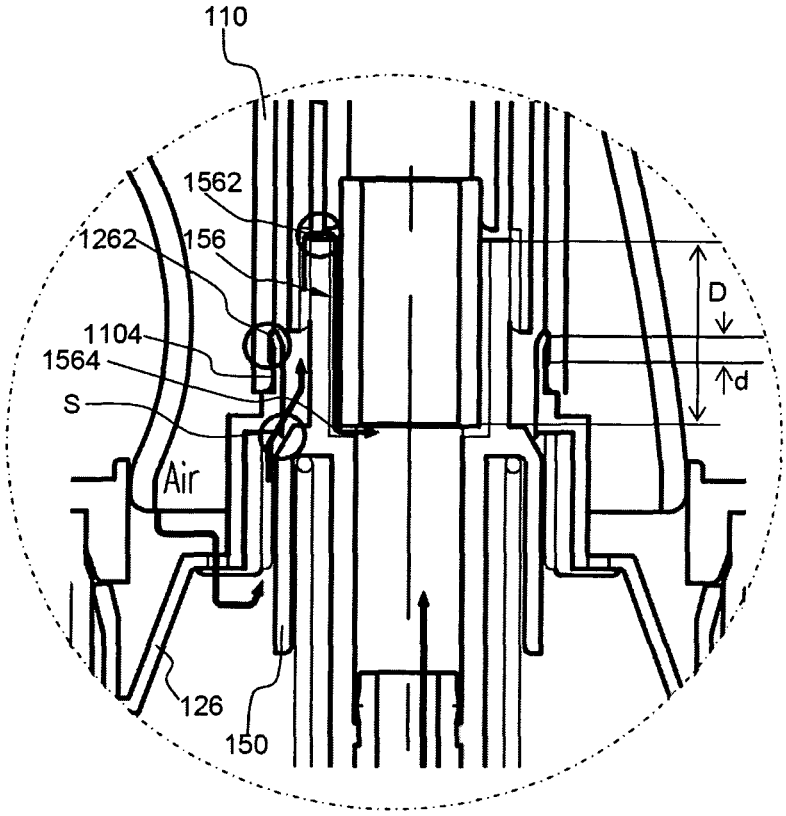
FIG. 5 is an enlarged partial vertical sectional view illustrating an upper part A of a shaft shown in FIG. 1.

FIG. 5 is an enlarged partial vertical sectional view typically illustrating the upper part A of the shaft shown in FIG. 1.

Referring to FIG. 5, the shaft air hole 156 includes an outside opening 1562 which is formed outside the shaft 150 and an inside opening 1564 which is formed inside the shaft 150. The height difference D between the outside opening 1562 and the inside opening 1564 is approximately 14 mm, by which the contents in the hollow channel of the shaft 150 are prevented from flowing backward to the shaft air hole 156 during pumping.

In the button 110 is formed an annular protrusion part 1104. The uppermost end 1262 of the air piston 126 is in contact with the annular protrusion part 1104 in a sliding fashion. Consequently, the annular protrusion part 1104 of the button 110 and the uppermost end 1262 of the air piston 126 move up and down within a sliding distance d of 0.5 mm in which the contact region S between the air piston 126 and the shaft 150 is opened in a pressurization mode, and is closed in a relaxation mode.

Figure 6:
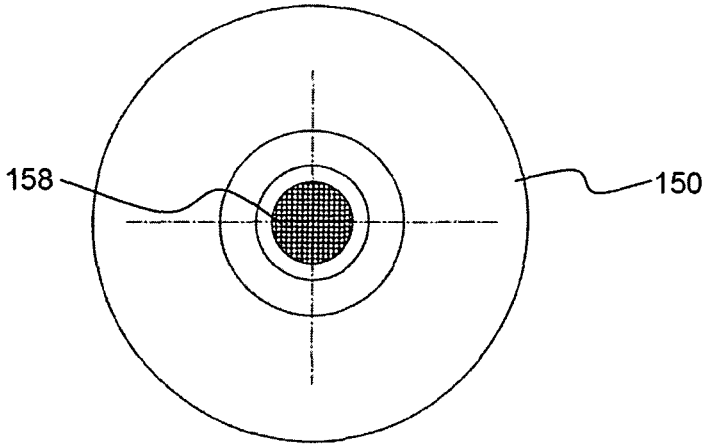
FIG. 6 is a horizontal sectional view illustrating the upper part A of the shaft shown in FIG. 1.

FIG. 6 is a horizontal sectional view typically illustrating the upper part A of the shaft shown in FIG. 1.

Referring to FIG. 6 together with FIG. 1, the foam net 158 is formed at the hollow upper part, which is open, of the shaft 150. The remaining part of the shaft 150 excluding the foam net 158 is closed. Consequently, the air passing through the shaft air hole 156 and the liquefied contents moving to the upper part of the shaft 150 from the solution space 124 of the housing 120 change into foam while passing through the foam net 158.

Figure 7:
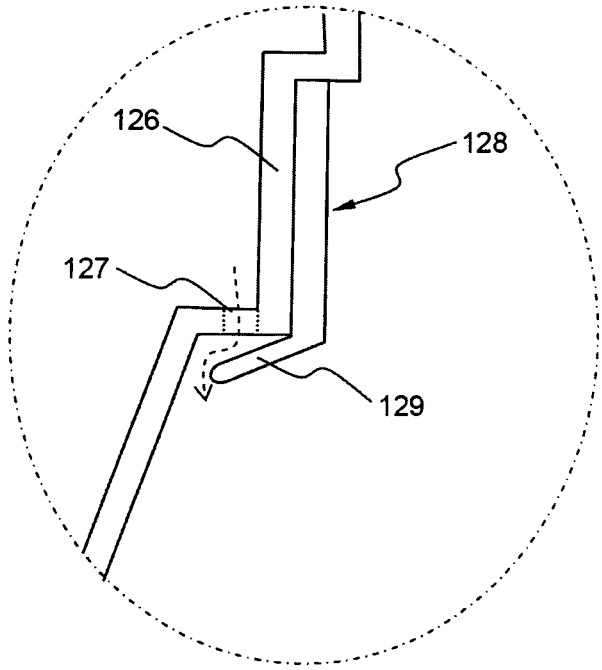
FIG. 7 is a partial typical view illustrating a state in which a thin membrane of an air valve is opened at part B shown in FIG. 1.

FIG. 7 is a partial typical view illustrating a state in which the thin membrane of the air valve is opened at part B shown in FIG. 1.

Referring to FIG. 6 together with FIG. 1, when the external air, which is in a relatively high pressure state, passes through the piston air hole 127 in the relaxation mode, as previously described, the air pushes the thin membrane 129 of the air valve 128 in tight contact with the lower end of the piston air hole 127. Subsequently, the air is introduced into the air space 122, which is in a low pressure state. In the pressurization mode, the thin membrane 129 of the air valve 128 closes the piston air hole 127, and a process reverse to the above-described process is carried out.

Figure 8:
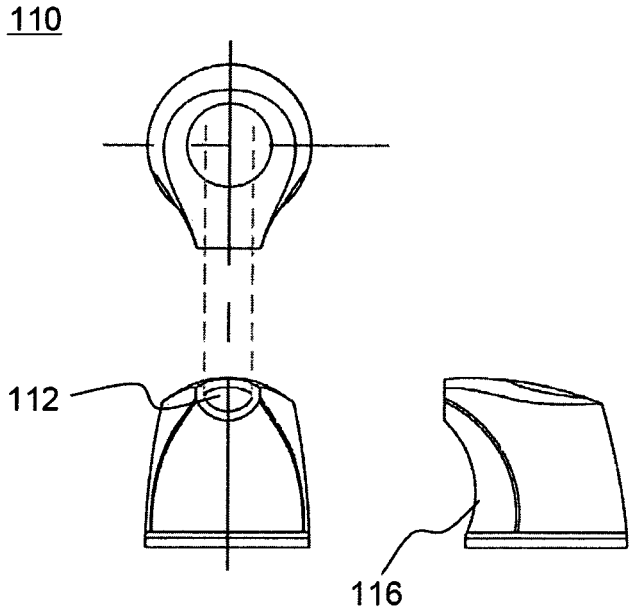
FIG. 8 is a plan view illustrating a button shown in FIG. 1 including a front view and a side view of the button.

FIG. 8 is a plan view typically illustrating the button shown in FIG. 1 including a front view and a side view of the button.

Referring to FIG. 8, the outlet port 112 is formed at the front upper end of the button 110 in an elliptical shape, and a semi-elliptical depression part 116 is formed at the front lower part of the button 110 in a downward taper structure.

Figure 9:
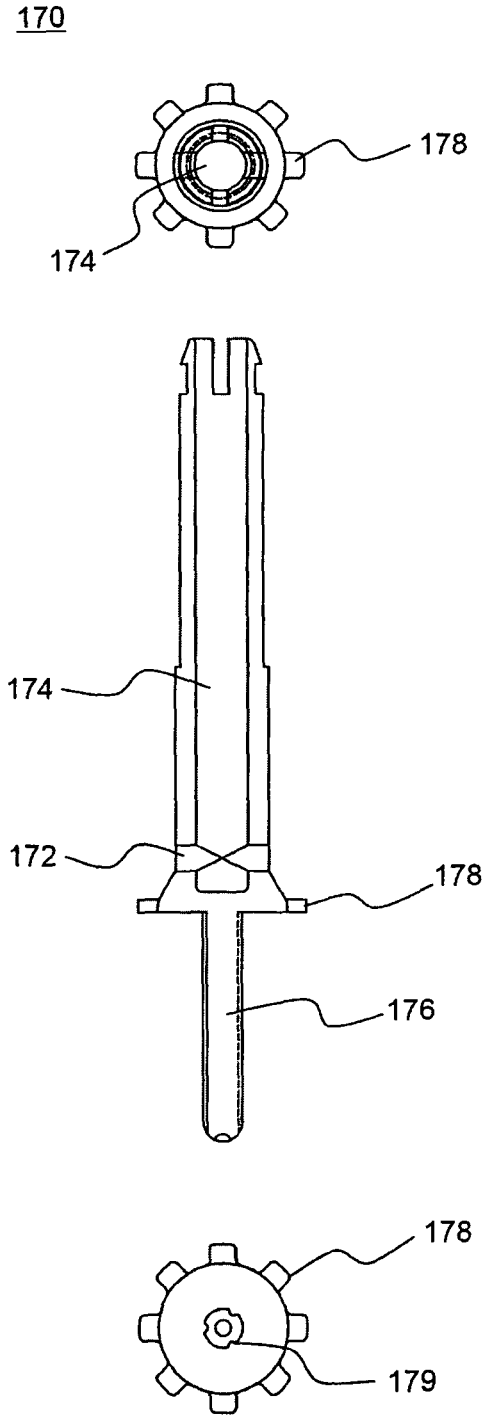
FIG. 9 is a vertical sectional view illustrating a stem shown in FIG. 1 including a plan view and a bottom view of the stem.

FIG. 9 is a vertical sectional view illustrating the stem shown in FIG. 1 including a plan view and a bottom view of the stem.

Referring to FIG. 9 together with FIG. 1, the stem 170 includes the horizontal channel 172, which communicates with the solution space 124 of the housing 120, the vertical channel 174, which vertically extends to communicate with the outlet port 112 of the button 110 and the horizontal channel 172, radial protrusions 178 formed below the horizontal channel 172, and the lower-end extension part 176 fitted in the opening and closing member 200.

The lower-end extension part 176 is movable up and down along the inside of the hollow part of the opening and closing member 200. In order to prevent the change of the pressure in the hollow part, micro grooves 179 are formed vertically at the lower-end extension part 176 such that the interior of the hollow part communicates with the solution space 124 of the housing 120 even when the lower-end extension part 176 is coupled to the opening and closing member 200.

Figure 10:
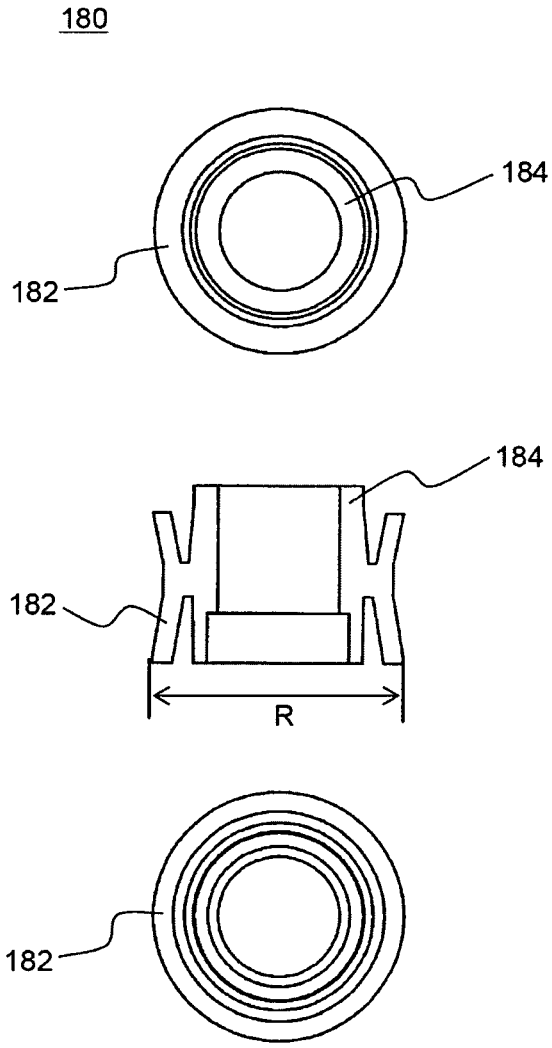
FIG. 10 is a vertical sectional view illustrating a solution piston shown in FIG. 1 including a plan view and a bottom view of the solution piston.

FIG. 10 is a vertical sectional view typically illustrating the solution piston shown in FIG. 1 including a plan view and a bottom view of the solution piston.

Referring to FIG. 10 together with FIG. 1, the solution piston 180 includes an outer circumferential part 182 contacting the inside of the housing 120 and an inner circumferential part 184 contacting the outside of the stem 170. The outer circumferential part 182 has an outer diameter R slightly greater than the inner diameter of the housing 120. The outer circumferential part 182 is bent outward at the upper and lower ends thereof.

Consequently, when the solution piston 180 is inserted into the housing 120, the upper and lower ends of the outer circumferential part 182 are bent inward such that the upper and lower ends of the outer circumferential part 182 correspond to the inner diameter of the housing 120. As a result, a frictional force of the outer circumferential part 182 with respect to the inside of the housing 120 becomes greater than that of the inner circumferential part 184 with respect to the inside of the stem 170. Due to the dual frictional force, the horizontal channel 172 of the stem 170 is opened and closed by the inner circumferential part 184 of the solution piston 180 during pumping, as previously described.

Figure 11:
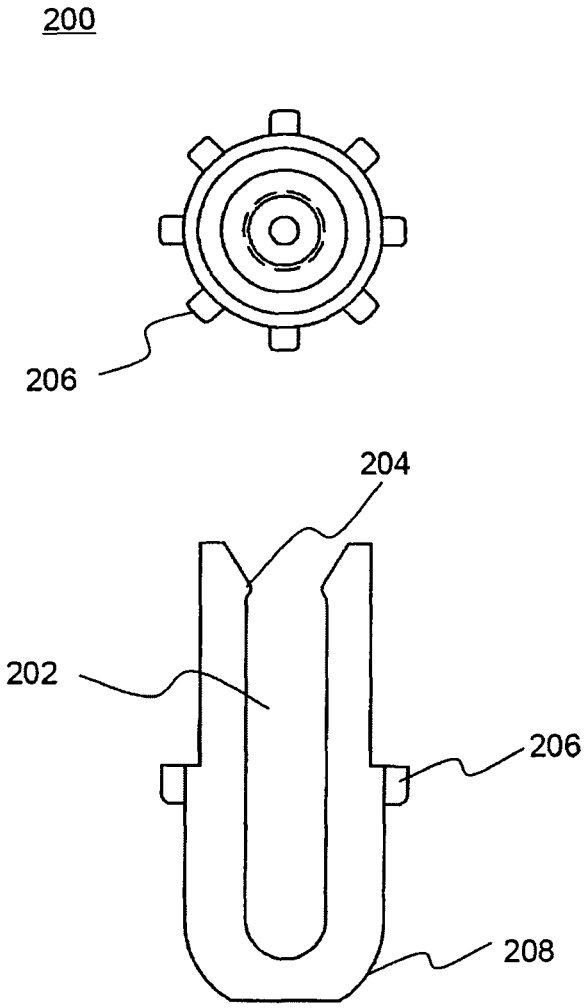
FIG. 11 is a vertical sectional view illustrating an opening and closing member shown in FIG. 1 including a plan view of the opening and closing member.

FIG. 11 is a vertical sectional view typically illustrating the opening and closing member shown in FIG. 1 including a plan view of the opening and closing member.

Referring to FIG. 11 together with FIG. 1, the opening and closing member 200 is configured in a hollow structure in which the upper part of the opening and closing member is open. The lower end of the opening and closing member 200 is rounded at the side 208 thereof such that the tight contact area between the opening and closing member 200 and the lower end inlet port 190 is increased in a pressurization mode in which the button 110 is pushed. The lower-end extension part 176 of the stem 170 is fitted in a hollow part 202 of the opening and closing member 200. In order to increase a frictional force of the opening and closing member 200 with respect to the lower-end extension part 176, a micro protrusion 204 is formed at the inside of the opening and closing member 200. Consequently, it is possible for the opening and closing member 200 to rapidly respond to the up-and-down motion of the stem 170.

The upward-movement of the opening and closing member 200 due to the upward-movement of the stem 170 is not stopped until radial protrusions 206 formed at the outside of the opening and closing member 200 reach side protrusions 125 formed at the inside of the housing 120. Even after the upward-movement of the opening and closing member 200 is stopped, the stem 170 continues to move upward. At this time, the contents stored in the container (not shown) are introduced into the solution space 124 of the housing 120 through gaps defined between the radial protrusions 206 and the side protrusions 125 formed at the inside of the housing 120.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As apparent from the above description, the foam production pump according to the present invention is widely applicable to various fields for producing shaving cream, hair mousse, facial cleansing cream, liquid soap, body shampoo, industrial multi-purpose cleanser, facial cleanser, etc.

The invention claimed is:

1. A foam production pump for discharging liquefied contents in the form of foam, comprising:

a button, having an outlet port defined therein, mounted at the upper end of a shaft;

a housing forming an external appearance of the pump, the housing having an air space, into which external air is introduced, and a solution space, into which contents are introduced, defined therein;

a closure coupled to an upper outside of the housing for mounting the housing to a predetermined container;

a stem having a horizontal channel communicating with the solution space of the housing and a vertical channel communicating with the horizontal channel defined therein, the stem being mounted in the lower part of the shaft for performing an up-and-down motion;

the shaft configured in a hollow channel structure, through which the contents pass, the shaft having an air hole, through which air from the air space is introduced, formed in an upper part thereof, the shaft being mounted in a lower part of the button, the shaft performing an up-and-down motion along an inside of a housing cap while a lower part of the shaft is coupled to an outside of the stem;

a foam net mounted at an open hollow upper part of the shaft for mixing the contents with the air to produce foam;

the housing cap for guiding the up-and-down motion of the shaft and isolating the air space and the solution space of the housing from each other;

an air piston configured in a multiple-stage structure, the air piston performing an up-and-down motion along an inside of the air space of the housing while being mounted at the lower part of the button, the air piston having an air hole formed in a middle part thereof, a contact region between the air piston and the shaft being opened and closed during pumping;

a solution piston mounted at the outside of the stem for opening and closing the horizontal channel of the stem, the solution piston performing an up-and-down motion along an inside of the solution space of the housing;

an air valve having a vertical section configured in an L type structure coupled to the multiple-stage structure of the air piston, the air valve opening and closing the piston air hole during pumping;

a first compression spring disposed between a lower end of the shaft and the solution piston for providing an elastic opening and closing force of the solution piston with respect to the horizontal channel of the stem during pumping;

a second compression spring disposed between a side protrusion part of the shaft and a support groove of the housing cap for providing a restoring force to the shaft and the air piston during pumping; and an opening and closing member disposed at a lower end of the solution space for opening and closing a lower end inlet port of the housing when pumping, wherein:

the button has an annular protrusion part formed therein;

the air piston has an uppermost end disposed in contact with the annular protrusion part in a sliding fashion; and the annular protrusion part of the button and the uppermost end of the air piston are configured to provide a sliding distance in which the contact region is opened in a pressurization mode during pumping, and the contact region is closed in a relaxation mode, wherein the shaft air hole includes an outside opening formed outside the shaft and an inside opening formed inside the shaft, the outside opening being located at a higher position than the inside opening such that the contents in the hollow channel structure are prevented from flowing backward to the shaft air hole, wherein the stem has a vertical extension part formed at a lower end thereof, the opening and closing member is configured with a hollow structure in which the upper part of the opening and closing member is open, the opening and closing member having radial protrusions formed at a side thereof such that the radial protrusions extend outward, the vertical extension part moves along the inside of the opening and closing member and in contact with the opening and closing member, and micro grooves are formed vertically at the vertical extension part such that the inside of the opening and closing member communicates with the solution space of the housing even when the vertical extension part is coupled to the opening and closing member.

2. The foam production pump according to claim 1, wherein the air valve includes a thin membrane formed at a region where the air valve is in contact with the piston air hole for closing the piston air hole in a pressurization mode when pumping and opening the piston air hole in a relaxation mode.

3. The foam production pump according to claim 1, wherein the sliding distance of the annular protrusion part of the button and the uppermost end of the air piston is 0.3 to 0.6 mm.

4. The foam production pump according to claim 1, wherein the foam net is configured in a net or mesh structure.

* * * * *